United States Patent [19]

Knechtel et al.

[11] 3,991,483

[45] Nov. 16, 1976

[54] PHOTOGRAPHIC COPYING APPARATUS

[75] Inventors: Wilhelm Knechtel, Biebertal; Gerhard Petersdorf, Pohlheim; Winfried Sandner, Rechtenbach, all of Germany

[73] Assignee: Canon Kabushiki Kaisha, Tokyo, Japan

[22] Filed: Apr. 21, 1975

[21] Appl. No.: 569,611

Related U.S. Application Data

[62] Division of Ser. No. 303,001, Nov. 2, 1972, Pat. No. 3,878,622.

[52] U.S. Cl. ..... 34/95; 34/155; 432/59; 219/216

[51] Int. Cl.[2] ..... F26B 13/26

[58] Field of Search ..... 432/59, 60, 227, 228; 34/95, 155, 152, 162; 219/216, 388, 469

[56] References Cited

UNITED STATES PATENTS

| | | | |
|---|---|---|---|
| 1,749,988 | 3/1930 | Sheffield | 432/189 |
| 2,039,429 | 5/1936 | Lydon | 432/194 |
| 2,181,928 | 12/1939 | Vaughan | 432/145 |
| 2,458,040 | 1/1949 | Weller | 432/145 |
| 2,933,825 | 4/1960 | Small | 34/152 |
| 3,071,866 | 1/1963 | Mangus | 34/95 |
| 3,074,332 | 1/1963 | Robinson | 34/152 |
| 3,100,632 | 8/1963 | Möhring | 432/145 |
| 3,296,710 | 1/1967 | Krikorian | 34/95 |
| 3,374,769 | 3/1968 | Carlson | 219/216 |
| 3,435,751 | 4/1969 | Goodman et al. | 34/162 |
| 3,440,944 | 4/1969 | Endermann et al. | 219/216 |
| 3,478,665 | 11/1969 | Umahashi et al. | 219/216 |
| 3,629,549 | 12/1971 | Svendsen | 219/469 |
| 3,668,817 | 6/1972 | Bell | 34/225 |
| 3,730,675 | 5/1973 | Previati | 432/60 |
| 3,739,143 | 6/1973 | Amundson et al. | 219/216 |
| 3,740,867 | 6/1973 | Hamaguchi | 34/95 |
| 3,763,533 | 10/1973 | Blom et al. | 29/132 |
| 3,878,622 | 4/1975 | Knechtel et al. | 34/95 |

*Primary Examiner*—John J. Camby
*Assistant Examiner*—Henry C. Yuen
*Attorney, Agent, or Firm*—Fitzpatrick, Cella, Harper & Scinto

[57] ABSTRACT

A photographic copying apparatus of the type in which a copy is guided through a hermetically sealed drying chamber disposed behind a developing liquid tank so that the copy may be dried by heat produced in the drying chamber is improved in that at least one heating plate is provided for guiding the copy thereon.

3 Claims, 3 Drawing Figures

PHOTOGRAPHIC COPYING APPARATUS

This is a division of application Ser. No. 303,001, filed Nov. 2, 1972, now U.S. Pat. No. 3,878,622.

BACKGROUND OF THE INVENTION

1. Field of the Invention

This invention relates to a photographic copying apparatus, and more particularly to an electrophotographic copying apparatus of the type in which a copy is guided through a hermetically sealed drying chamber disposed behind a developing liquid tank so that the copy may be dried by heat produced in the drying chamber.

2. Description of the Prior Art

In the copying apparatus of the described type, the heat in the drying chamber evaporates developing liquid and such vapor produced from the developing liquid is collected as condensate in a suitable container without being discharged outwardly.

In such drying means, it has been recognized as essential to control the amount of heat highly accurately. Too small an amount of heat in the drying chamber would cause a copy to be insufficiently dried during the passage thereof through the drying chamber, and conversely, too great an amount of heat would cause the danger of explosion of vapor.

SUMMARY OF THE INVENTION

It is an object of the present invention to improve the apparatus of the above-described type so that a constant drying temperature may be maintained highly accurately.

According to the present invention, such object may be achieved by providing at least one heating plate for guiding a copy thereon. The heating plate may preferably comprise an aluminum plate having heating coils contained therein. The temperature of the heating plate may be very accurately measured and controlled by a temperature sensor.

By the supply of the controlled heat, the temperature of the aluminum plate may always be maintained at a level lower than the fire point of developing liquid vapor and higher than the gasification point of the developing liquid. This ensures satisfactory drying of the copy to be accomplished without the danger of explosion of the vapor.

It has been found convenient to move the copy by the use of transport means, especially transport rolls disposed on and in opposed relationship with the heating plate. Preferably, the transport means should urge the copy against the heating plate lightly or resiliently.

With such arrangement, the copy may be raised away from the aluminum plate due to a vapor cushion formed between the copy and the heating plate so that the copy may be transported without any friction produced.

By way of precaution against the cases where such a cushion fails to be provided, and in order to ensure further safety if desired, the upper surface of the aluminum plate may have a lower friction coefficient. For this purpose, the upper surface of the aluminum plate may preferably be covered with a coating layer such as Teflon layer.

In a further preferred embodiment, a number of transport rolls are used and each of them may be disposed on a heating coil and in opposed relationship with the heating coil position, i.e. maximum temperature position.

Each transport roll may preferably be covered with fur, velvet or like material so that the substantial transportation of the copy may be effected by the hair of the fur or velvet.

The fur or velvet may preferably be in the form of a strip and wound helically around each transport roll.

Conveniently, the first and the last of the transport rolls may be arranged so that they also seal the entrance and exit of the drying chamber, respectively. Such arrangement is especially advantageous in that where the heating plate itself is the outer wall of the drying chamber, the hair of the coating layers on the first and last transport rolls provides a filler with respect not only to the aluminum plate but also to the ceiling of the drying chamber.

The heating plate may be a flat aluminum plate as described above, or a member similar thereto.

According to another embodiment of the present invention, two heating shoes in the horseshoe shape and surrounding respective transport rolls may be provided in the drying chamber. These transport rolls may also be covered with fur or velvet as in the aforesaid case. This embodiment provides a very much space-saving device as by arranging the two heating shoes so that a copy may enter the second heating shoe as soon as it leaves the first heating shoe.

BRIEF DESCRIPTION OF THE DRAWINGS

The invention will be described in greater detail with reference to the accompanying drawings, in which.

DESCRIPTION OF THE PREFERRED EMBODIMENTS

Figure 1:
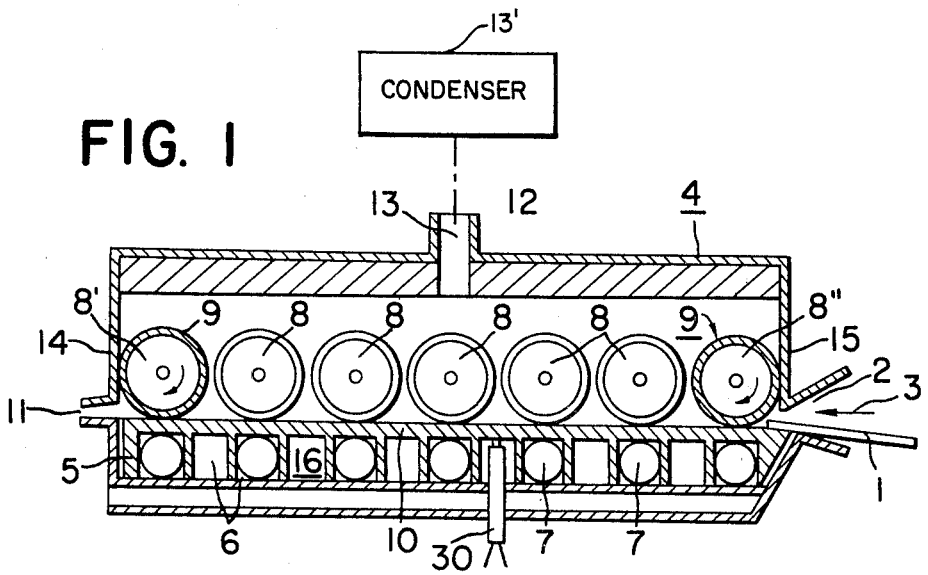
FIG. 1 schematically illustrates a first embodiment of the present invention.

Referring to FIG. 1, a copy 1 coming in from an unshown developer tank passes through an opening 2 in the direction of arrow 3 to reach a drying chamber 4. The lower wall of the drying chamber is formed of an aluminum plate 5. The aluminum plate 5 has a number of hollow chamber 6. A heating coil 7 is mounted in each of the hollow chambers. Transport rolls 8 are disposed above the heating coils and provided with coating layers of velvet 9. The hair of the velvet 9 urges the copy 1 against the surface 10 of the aluminum plate and moves the copy until it leaves an outlet opening 11. The upper portion of the drying chamber is covered with an adiabatic material 12. Any vapor produced from developing liquid during the drying is directed through a discharge tube 13 to a condenser 13'.

The velvet hair on the transport rolls is not only useful for the transportation of the copy. The velvet hair between transport rolls 8' and 8'' is also useful to seal the interior of the drying chamber 4 with respect to the openings 2 and 11. For this reason, the rolls 8' and 8'' contact not only the surface of the aluminum plate 5 but also the end walls 14 and 15 of the drying chamber 4. The surface 10 of the aluminum plate 5 is covered with a Teflon layer 16 which facilitates the sliding movement of the copy 1 on the aluminum plate 5. The Teflon layer is provided simply for the sake of safety and reliability because when the aluminum plate 5 is at an operating temperature a vapor cushion is usually formed between the copy 1 and the aluminum plate 5 to thereby raise the copy 1 slightly from the aluminum plate 5 so as to urge the copy against the rolls 8. The rolls 8 are disposed above the heating coils in opposed relationship therewith so that the pressure force of the rolls is applied to the copy at the maximum temperature positions.

Figure 3:
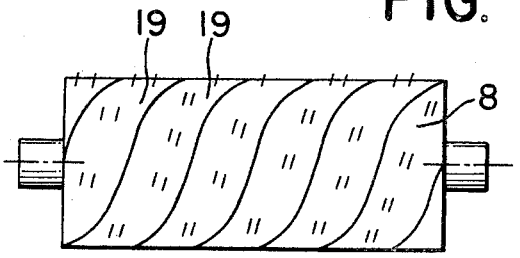
FIG. 3 shows in detail a portion of the apparatus of FIG. 1.

As is apparent from FIG. 3, a velvet strip 19 is helically wound around the body of each roll 8.

Figure 2:
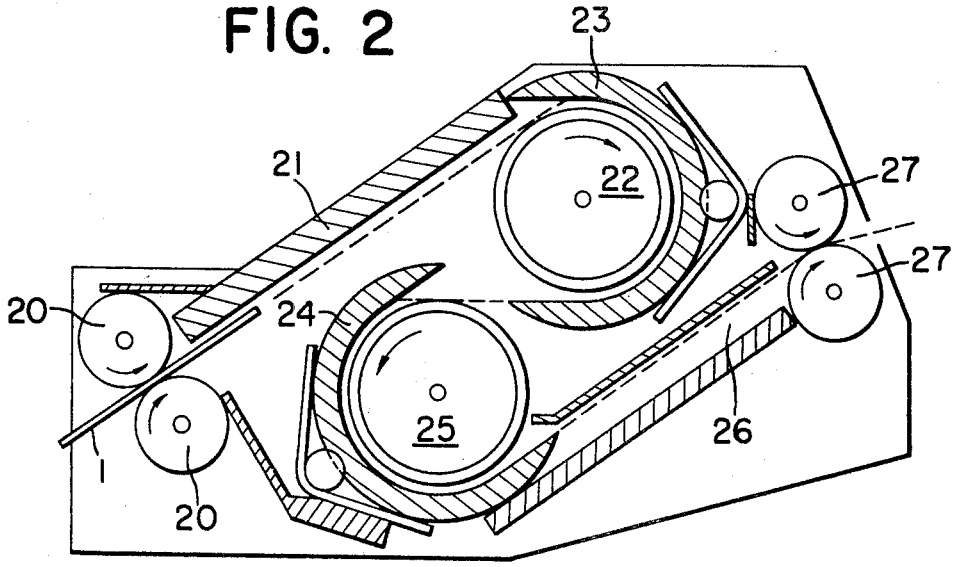
FIG. 2 illustrates a second embodiment.

In the embodiment of FIG. 2, the copy 1 is guided into a drying chamber 21 by transport rolls 20. A velvet or fur strip is wound on a roll 22 in the drying chamber, which roll guides the copy 1 around a heating shoe 23 formed in the horseshoe shape. As soon as the copy passes the heating shoe 23, it enters another heating shoe 24 and is transported by a roll 25. When it reaches a point designated at 26, the copy is nipped between another set of transport rolls 27 for discharge.

As shown in FIG. 1, a temperature sensor 30 normally measures the temperature of the aluminum plate 5 and limits the conduction of electrical energy. The heating shoes 23 and 24 of FIG. 2 are similarly provided with temperature sensors.

We claim:

1. A device for drying and fixing a toner image on copy material comprising: a drying chamber having an entrance and an exit, first and second heating means each having an inner concave surface in said chamber for supporting said copy material and having an outer surface, first and second guiding rollers disposed respectively adjacent said concave surfaces, said guiding rollers having a non-smooth surface to assist the transportation of said copy material, said concave surfaces being disposed so that said copy material may pass from one to the other thereof, whereby said copy material travels between said first guiding roller and its respective concave surface and said second guiding roller and its respective concave surface, a pair of opposed rolls sealing the entrance of said chamber operative to direct said copy material to pass between said first concave surface and said first guiding roller, and a pair of opposed rolls sealing the exit of said chamber operative to receive said copy material from between said second concave surface and said second guiding roller, said outer surfaces of said first and second heating means forming at least portions of the outer surface of said drying chamber.

2. A copying device according to claim 1, wherein said guiding rollers are coated with coating material of fur or velvet.

3. A copying device according to claim 2, wherein said coating material is in the form of a belt and is helically wound around said guiding rollers.

* * * * *

UNITED STATES PATENT AND TRADEMARK OFFICE

CERTIFICATE OF CORRECTION

PATENT NO. : 3,991,483

DATED : November 16, 1976

INVENTOR(S) : Wilhelm Knechtel, et al.

It is certified that error appears in the above-identified patent and that said Letters Patent is hereby corrected as shown below:

ON THE COVER

Under item [21] insert the following additional information:

--[30] Foreign Application Priority Data

Nov. 6, 1971 Germany.....2155248--.

Signed and Sealed this

Fifth Day of September, 1989

*Attest:*

DONALD J. QUIGG

*Attesting Officer*

*Commissioner of Patents and Trademarks*